US005971142A

United States Patent [19]

Jones

[11] Patent Number: 5,971,142

[45] Date of Patent: Oct. 26, 1999

[54] ABSORBENT WIPE DISPENSING DEVICE

[76] Inventor: William S. V. Jones, 2411 Cedarhill Road, Victoria BC, Canada, V8T 3G6

[21] Appl. No.: 09/156,143

[22] Filed: Sep. 17, 1998

[51] Int. Cl.[6] ..... B65D 83/00

[52] U.S. Cl. ..... 206/233; 206/806; 206/823

[58] Field of Search ..... 248/205.1, 213.2, 248/231.91; 206/233, 581, 494, 806, 823

[56] References Cited

U.S. PATENT DOCUMENTS 4,106,616 8/1978 Boone ..... 206/233
4,978,095 12/1990 Phillips ..... 206/233

*Primary Examiner*—Jacob K. Ackun

[57] ABSTRACT

A new absorbent wipe dispensing device for dispensing absorbent wipes to protect a person from germs and infections while using a public toilet. The inventive device includes a wall panel adapted for removable securement to a wall. The wall panel has a lower collar extending from it. The lower collar has open upper and lower ends. A container for holding a supply of absorbent wipes is slidably received within the lower collar. The container has an open upper end for removal of the absorbent wipes. An upper collar is hingedly secured to the lower collar. The upper collar has an open upper end and a closed lower end. The closed lower end of the upper collar has an opening through it to allow for passage of absorbent wipes therethrough.

8 Claims, 3 Drawing Sheets

ABSORBENT WIPE DISPENSING DEVICE

BACKGROUND OF THE INVENTION

1. Field of the Invention

The present invention relates to wipe dispensers and more particularly pertains to a new absorbent wipe dispensing device for dispensing absorbent wipes to protect a person from germs and infections while using a public toilet.

2. Description of the Prior Art

The use of wipe dispensers is known in the prior art. More specifically, wipe dispensers heretofore devised and utilized are known to consist basically of familiar, expected and obvious structural configurations, notwithstanding the myriad of designs encompassed by the crowded prior art which have been developed for the fulfillment of countless objectives and requirements.

Known prior art wipe dispensers include U. S. Pat. No. 3,967,756 to Barish; U.S. Pat. No. 4,865,221 to Jackson et al; U.S. Pat. No. 5,242,057 to Cook et al; U.S. Pat. No. 4,575,891 to Valente; U.S. Pat. No. 4,998,984 to McClendon; and U.S. Pat. No. Des. 354,224 to Norton et al.

While these devices fulfill their respective, particular objectives and requirements, the aforementioned patents do not disclose a new absorbent wipe dispensing device. The inventive device includes a wall panel adapted for removable securement to a wall of a wall. A lower collar is secured to the wall panel. The lower collar includes open upper and lower ends. A container is slidably received within the lower collar. The container holds a supply of absorbent wipes therein. The container has an open upper end for removal of the absorbent wipes. The open upper end has a peripheral flange disposed around an outer peripheral edge thereof. The peripheral flange abuts the open upper end of the lower collar to facilitate securement of the container to the lower collar. An upper collar is hingedly secured to the lower collar. The upper collar has an open upper end and a closed lower end. The closed lower end has an opening therethrough to allow for passage of absorbent wipes therethrough. The upper collar has a lid member coupled thereto by a spring hinge. The lid member is dimensioned for covering the open upper end of the upper collar.

In these respects, the absorbent wipe dispensing device according to the present invention substantially departs from the conventional concepts and designs of the prior art, and in so doing provides an apparatus primarily developed for the purpose of dispensing absorbent wipes to protect a person from germs and infections while using a public toilet.

SUMMARY OF THE INVENTION

In view of the foregoing disadvantages inherent in the known types of wipe dispensers now present in the prior art, the present invention provides a new absorbent wipe dispensing device construction wherein the same can be utilized for dispensing absorbent wipes to protect a person from germs and infections while using a public toilet.

The general purpose of the present invention, which will be described subsequently in greater detail, is to provide a new absorbent wipe dispensing device apparatus and method which has many of the advantages of the wipe dispensers mentioned heretofore and many novel features that result in a new absorbent wipe dispensing device which is not anticipated, rendered obvious, suggested, or even implied by any of the prior art wipe dispensers, either alone or in any combination thereof.

To attain this, the present invention generally comprises a wall panel adapted for removable securement to a wall. The wall panel has a lower collar extending from it. The lower collar has open upper and lower ends. A container for holding a supply of absorbent wipes is slidably received within the lower collar. The container has an open upper end for removal of the absorbent wipes. An upper collar is hingedly secured to the lower collar. The upper collar has an open upper end and a closed lower end. The closed lower end of the upper collar has an opening through it to allow for passage of absorbent wipes therethrough.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new absorbent wipe dispensing device apparatus and method which has many of the advantages of the wipe dispensers mentioned heretofore and many novel features that result in a new absorbent wipe dispensing device which is not anticipated, rendered obvious, suggested, or even implied by any of the prior art wipe dispensers, either alone or in any combination thereof.

It is another object of the present invention to provide a new absorbent wipe dispensing device which may be easily and efficiently manufactured and marketed.

It is a further object of the present invention to provide a new absorbent wipe dispensing device which is of a durable and reliable construction.

An even further object of the present invention is to provide a new absorbent wipe dispensing device which is susceptible of a low cost of manufacture with regard to both materials and labor, and which accordingly is then susceptible of low prices of sale to the consuming public, thereby making such absorbent wipe dispensing device economically available to the buying public.

Still yet another object of the present invention is to provide a new absorbent wipe dispensing device which provides in the apparatuses and methods of the prior art some of the advantages thereof, while simultaneously overcoming some of the disadvantages normally associated therewith.

Still another object of the present invention is to provide a new absorbent wipe dispensing device for dispensing absorbent wipes to protect a person from germs and infections while using a public toilet.

Yet another object of the present invention is to provide a new absorbent wipe dispensing device which includes a wall panel adapted for removable securement to a wall of a wall. A lower collar is secured to the wall panel. The lower collar includes open upper and lower ends. A container is slidably received within the lower collar. The container holds a supply of absorbent wipes therein. The container has an open upper end for removal of the absorbent wipes. The open upper end has a peripheral flange disposed around an outer peripheral edge thereof. The peripheral flange abuts the open upper end of the lower collar to facilitate securement of the container to the lower collar. An upper collar is hingedly secured to the lower collar. The upper collar has an open upper end and a closed lower end. The closed lower end has an opening therethrough to allow for passage of absorbent wipes therethrough. The upper collar has a lid member coupled thereto by a spring hinge. The lid member is dimensioned for covering the open upper end of the upper collar.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
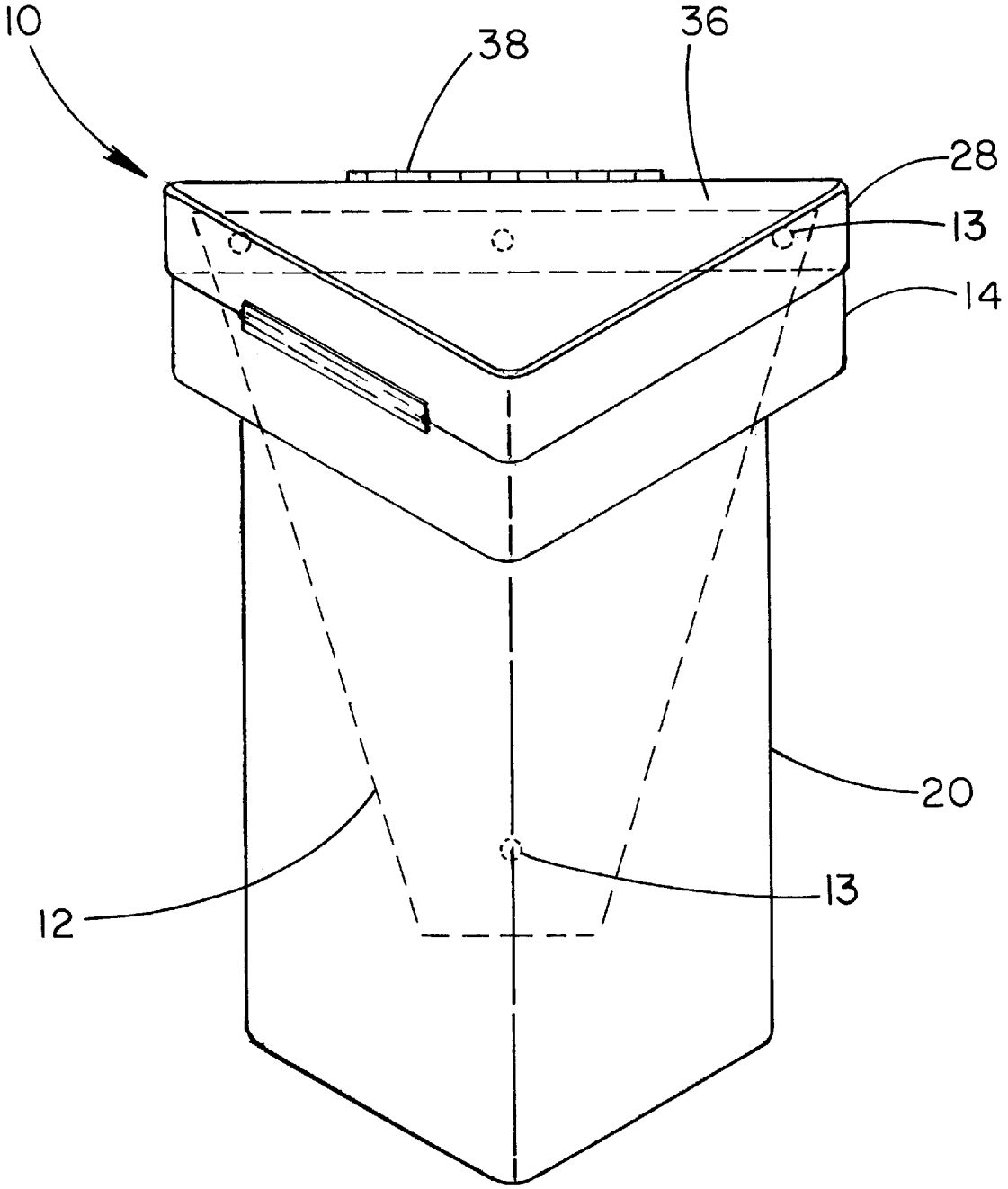
FIG. 1 is an isometric view of a new absorbent wipe dispensing device according to the present invention.
Figure 2:
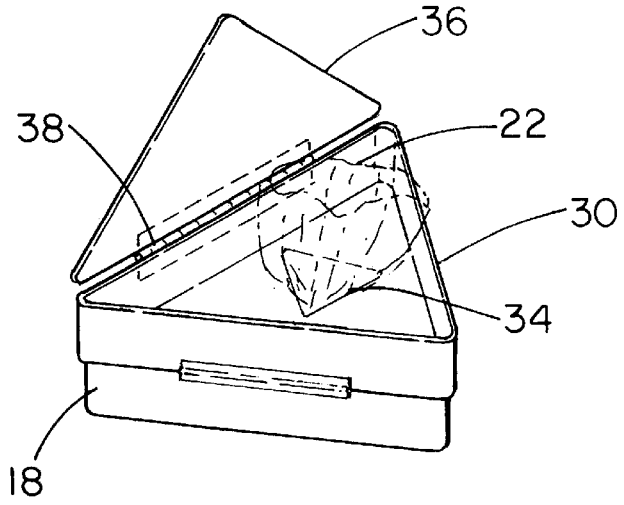
FIG. 2 is a perspective view of the upper and lower collars of the present invention illustrated in a closed orientation.
Figure 3:
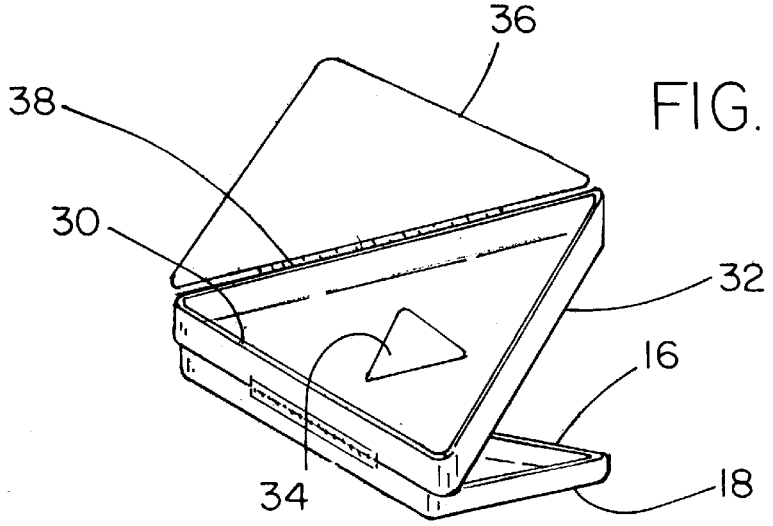
FIG. 3 is a perspective view of the upper and lower collars of the present invention illustrated in an open orientation.
Figure 4:
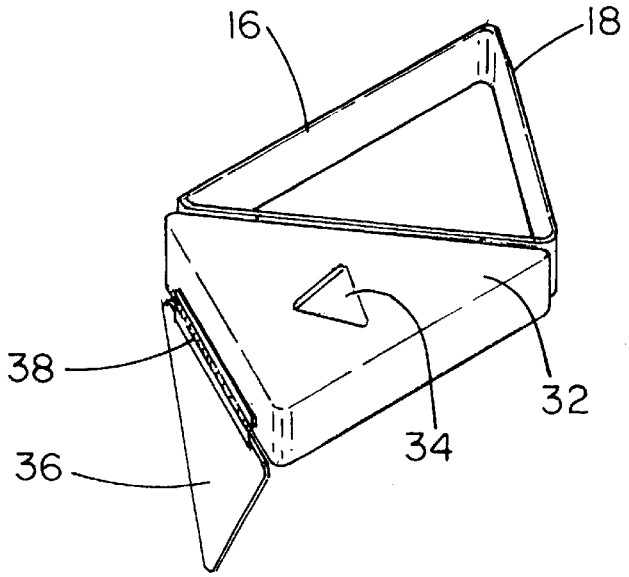
FIG. 4 is a plan perspective view of the upper and lower collars of the present invention illustrated in an open orientation.

With reference now to the drawings, and in particular to FIGS. 1 through 5 thereof, a new absorbent wipe dispensing device embodying the principles and concepts of the present invention and generally designated by the reference numeral 10 will be described.

As best illustrated in FIGS. 1 through 5, the absorbent wipe dispensing device 10 comprises a wall panel 12 adapted for removable securement to a wall, such as a wall of a bathroom stall. The wall panel 12 has a lower collar 14 extending from it. The lower collar 14 has open upper and lower ends. A container 20 for holding a supply of absorbent wipes is slidably received within the lower collar 14. The container 20 has an open upper end 24 for removal of the absorbent wipes 22. An upper collar 28 is hingedly secured to the lower collar 14. The upper collar 28 has an open upper end 30 and a closed lower end 32. The closed lower end 32 of the upper collar 28 has an opening through it to allow for passage of absorbent wipes 22 therethrough.

The wall panel 12 could be secured to any area within a public restroom or within each stall within the bathroom for each individual toilet. The wall panel 12 is provided with apertures 13 therethrough to facilitate securement to a wall. The apertures 13 would receive mounting screws therethrough. Preferably, the wall panel 12 has a wide upper end and a narrow lower end.

Ideally, the lower collar 14 extends from the wide upper end of the wall panel 12. The lower collar 14 includes a back member 16 and a pair of forwardly extending members 18.

Preferably, the upper collar 28 has a lid member 36 being coupled to an upper back edge thereof. The lid member 36 is dimensioned for covering the open upper end 30 of the upper collar 28 to limit the amount of fluid that evaporates from the absorbent wipes 22. More preferably, the lid member 36 is coupled to the upper collar 28 by a spring hinge 38 to bias the lid member 36 towards a closed position.

Figure 5:
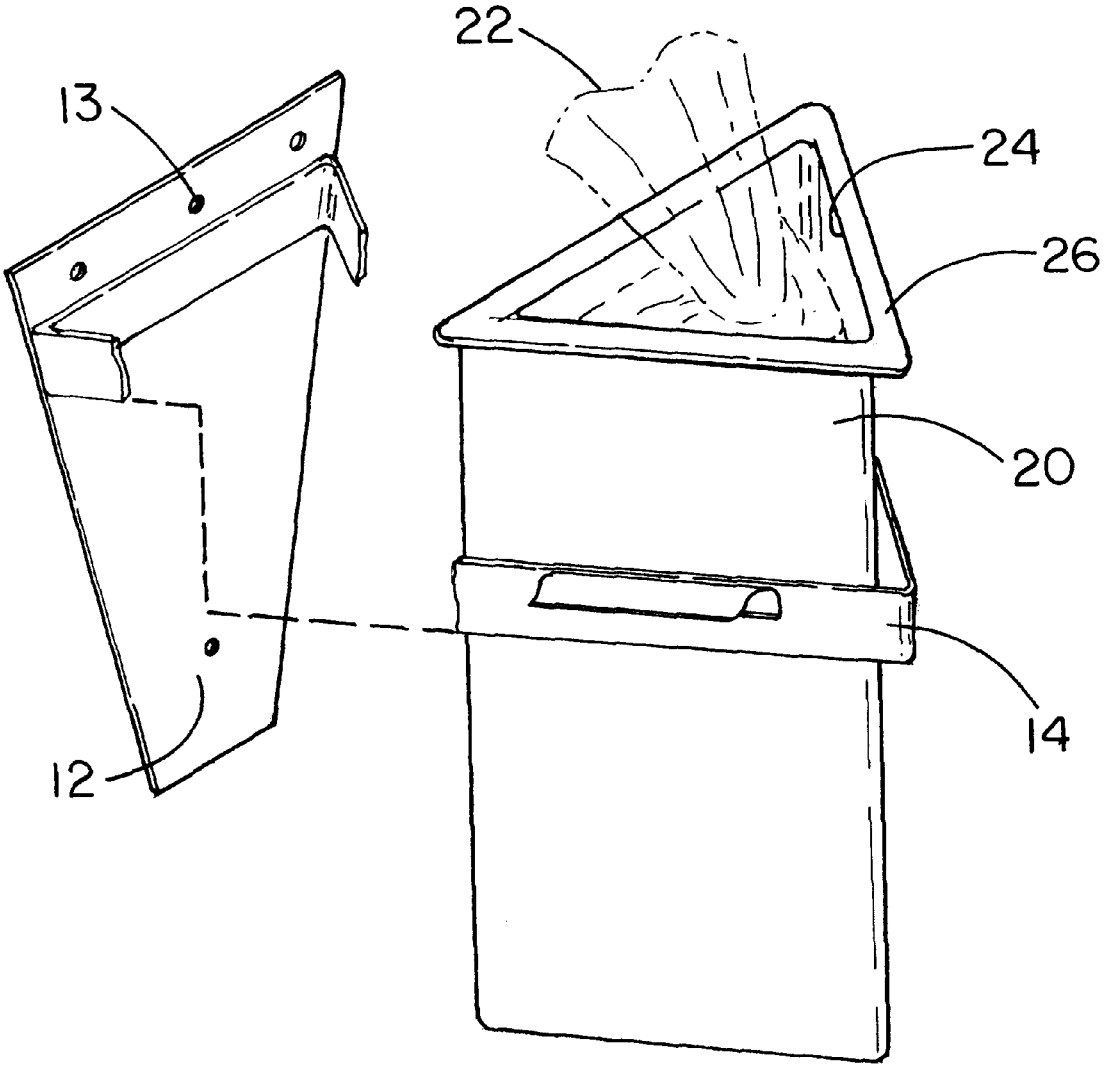
FIG. 5 is an exploded perspective view of the present invention.

Also preferably, as shown in FIG. 5, the open upper end 24 of the container 20 has a peripheral flange 26 disposed around an outer peripheral edge thereof. The peripheral flange 26 abuts the open upper end 24 of the lower collar 14 to facilitate securement of the container 20 to the lower collar 14. The absorbent wipes 22 are preferably disposed on a roll with a perforated line separating individual wipes 22 for easy separation.

Preferably, the lower collar 14 and the upper collar 28 have a generally triangular configuration. Ideally, all corners of the upper and lower collars 28,14 are rounded. Also preferably, the container 20 has a generally triangular cross-section with rounded corners and edges. The closed lower end 32 of the upper collar 28 has a triangular shaped opening 34 through it to allow for passage of absorbent wipes 22 therethrough.

In use, the user would simply lift the lid member 36, remove an absorbent wipe 22 through the opening 34, and would tear along the perforated edges of the wipe 22. The wipe 22 would be used to quickly and easily remove germs and bacteria from a toilet seat before use. The wipe 22 would also disinfect and deodorize the toilet seat. After use, the wipe 22 could be thrown into the toilet bowl and flushed. When empty, the container 20 can be refilled simply by removing the upper collar 28 and sliding the container 20 out of the lower collar 14 and replacing it with a new container.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An absorbent wipe dispensing device for dispensing absorbent wipes to protect a person from germs and infections while using a public toilet comprising, in combination:

a wall panel adapted for removable securement to a wall of a bathroom stall, the wall panel having a wide upper end and a narrow lower end;

the wall panel having a lower collar extending from the wide upper end of the wall panel, the lower collar having a triangular configuration, the lower collar including open upper and lower ends;

a container slidably received within the lower collar, the container holding a supply of absorbent wipes therein, the container having a generally triangular cross-section, the container having an open upper end for removal of the absorbent wipes, the open upper end having a peripheral flange disposed around an outer peripheral edge thereof, the peripheral flange abutting the open upper end of the lower collar to facilitate securement of the container to the lower collar;

an upper collar hingedly secured to the lower collar, the upper collar having a generally triangular configuration, the upper collar having an open upper end and a closed lower end, the closed lower end having a triangular shaped opening therethrough to allow for passage of absorbent wipes therethrough, the upper collar having a lid member being coupled to an upper back edge thereof by a spring hinge, the lid member being dimensioned for covering the open upper end of the upper collar.

2. An absorbent wipe dispensing device for dispensing absorbent wipes to protect a person from germs and infections while using a public toilet comprising, in combination:

a wall panel adapted for removable securement to a wall;

the wall panel having a lower collar extending therefrom, the lower collar including open upper and lower ends;

a container slidably received within the lower collar, the container holding a supply of absorbent wipes therein, the container having an open upper end for removal of the absorbent wipes;

an upper collar hingedly secured to the lower collar, the upper collar having an open upper end and a closed lower end, the closed lower end having an opening therethrough to allow for passage of absorbent wipes therethrough.

3. The absorbent wipe dispensing device of claim 2, wherein the upper collar has a lid member being coupled to an upper back edge thereof, the lid member being dimensioned for covering the open upper end of the upper collar.

4. The absorbent wipe dispensing device of claim 3, wherein the lid member is coupled to the upper collar by a spring hinge.

5. The absorbent wipe dispensing device of claim 2, wherein the open upper end of the container has a peripheral flange disposed around an outer peripheral edge thereof, the peripheral flange abutting the open upper end of the lower collar to facilitate securement of the container to the lower collar.

6. The absorbent wipe dispensing device of claim 2, wherein the lower collar has a triangular configuration, the upper collar having a generally triangular configuration.

7. The absorbent wipe dispensing device of claim 2, wherein the wall panel has a wide upper end and a narrow lower end.

8. The absorbent wipe dispensing device of claim 2, wherein the lower collar of the wall panel has a pair of handles extending therefrom.

* * * * *